United States Patent [19]

Kochevar

[11] Patent Number: 4,593,913

[45] Date of Patent: Jun. 10, 1986

[54] WEIGHTED ARROWHEAD AND METHOD

[76] Inventor: Rudolph J. Kochevar, 252 Arbolada Dr., Arcadia, Calif. 91006

[21] Appl. No.: 622,787

[22] Filed: Jun. 21, 1984

Related U.S. Application Data

[63] Continuation-in-part of Ser. No. 497,424, May 24, 1983, Pat. No. 4,502,687.

[51] Int. Cl.[4] ..... F41B 5/02

[52] U.S. Cl. ..... 273/420; 156/309.6; 156/334

[58] Field of Search ..... 273/419–423, 273/171, 169; 156/309.6, 334, 524, 252

[56] References Cited

U.S. PATENT DOCUMENTS

| | | | |
|---|---|---|---|
| 1,529,009 | 3/1925 | Carpenter | 273/171 |
| 1,789,575 | 1/1931 | Allen | 273/420 |
| 2,579,488 | 12/1951 | Freeman | 156/309.6 X |
| 2,823,157 | 2/1958 | Hofferbert et al. | 156/309.6 X |
| 2,950,574 | 8/1960 | Slater et al. | 156/309.6 X |
| 3,356,782 | 12/1967 | Whyte | 273/171 |
| 3,638,347 | 2/1972 | Kochevar | 43/42.39 |
| 3,782,025 | 1/1974 | Kochevar | 43/44.9 |
| 4,010,958 | 3/1977 | Long | 273/169 |
| 4,050,696 | 9/1977 | Troncoso, Jr. | 273/420 |
| 4,220,336 | 9/1980 | Kochevar | 273/169 |
| 4,313,607 | 2/1982 | Thompson | 273/167 H |
| 4,452,456 | 6/1984 | Kochevar | 273/169 |
| 4,455,186 | 6/1984 | Koehmstedt | 156/309.6 X |

FOREIGN PATENT DOCUMENTS

| | | | |
|---|---|---|---|
| 211781 | 1/1957 | Australia | 273/169 |

*Primary Examiner*—Paul E. Shapiro
*Attorney, Agent, or Firm*—Gordon L. Peterson

[57] ABSTRACT

A method of weighting an arrowhead having a wall defining an interior passage and a pointed end comprising introducing an adhesive weight composition of the desired weight and in a solid state into the passage and heating the arrowhead and weight composition to an elevated temperature within the passage with the composition being flowable at such elevated temperature and cooling the adhesive weight composition to a solid state to strongly adhere the weight composition to the wall of the passage to such an extent that the adhesive weight composition is not likely to release from the wall during normal use of the arrowhead. An arrowhead having a wall defining an interior passage opening at a surface of the arrowhead and a pointed end for penetrating an object. An adhesive weight composition which is sticky in the solid state and cured in situ is located in the passage. The weight composition is strongly adhered to the wall of the passage and is pliable in the solid state.

18 Claims, 6 Drawing Figures

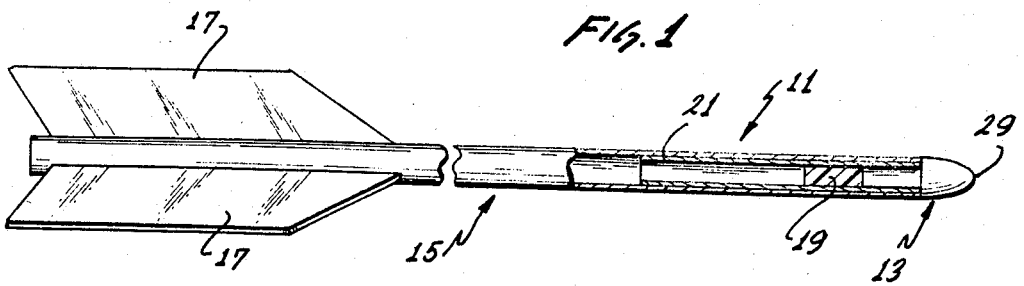
Fig. 1
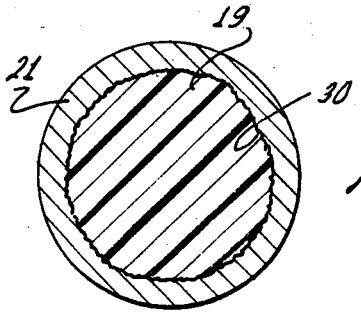
Fig. 4
Fig. 2
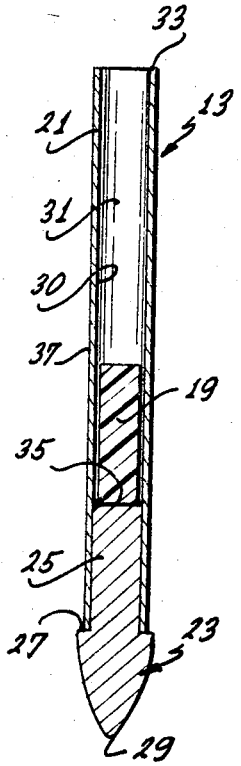
Fig. 3
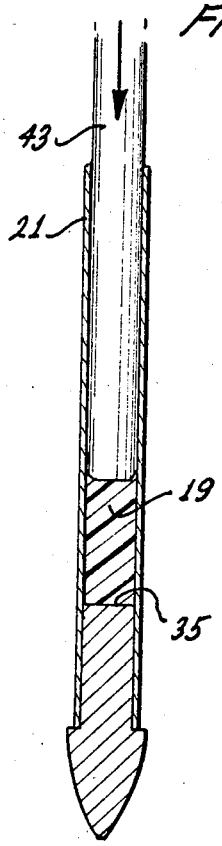
Fig. 5
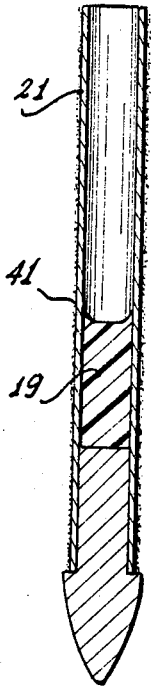
Fig. 6
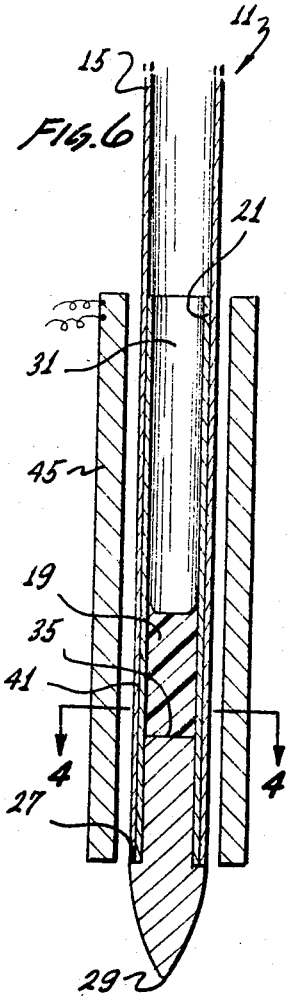

WEIGHTED ARROWHEAD AND METHOD

BACKGROUND OF THE INVENTION

This application is a continuation-in-part of application Ser. No. 497,424 filed May 24, 1983, now U.S. Pat. No. 4,502,687, issued Mar. 5, 1985, entitled Golf Club Head And Method of Weighting.

The parent application relates to weighting a golf club head with a weight composition. The present application applies essentially the same weight composition and many techniques of the parent application to weighting of an arrowhead.

An arrow typically includes an arrowhead having a pointed end for penetrating an object, a shaft coupled to the arrowhead, and feathers or other means for stabilizing the arrow at the trailing edge of the shaft. An arrow is subjected to very high impact loads when it is shot from a bow. This impact can cause the arrow to flex, and to minimize or control the flexure, it is desirable to control the location of the center of gravity of the arrow. For example, it is common practice to locate the center of gravity of an arrow just forward, i.e., toward the arrowhead, from the mid-point of the arrow.

Arrows are commonly made by the skilled archer, and different lengths of arrow shafts may be employed. A common techinque for attempting to locate the center of gravity of the arrow is to provide an assortment of arrowheads, each having a different weight. Accordingly, by selecting the appropriate weight arrowhead for a particular arrow shaft, the center of gravity of the arrow can be controlled.

Arrowheads are typically manufactured from metal, such as aluminum, and the weight of each arrowhead is a function of the amount of metal used in manufacturing the arrowhead. One problem with this technique is that it requires the arrowhead manufacturer to manufacture an assortment of arrowheads, each having a different mass of the metal.

SUMMARY OF THE INVENTION

With this invention, the arrowhead manufacturer only needs to manufacture only a single arrowhead, and the weight of the arrowhead is controlled by appropriately weighting the arrowhead with an adhesive weight composition. In this manner, the location of the center of gravity of the arrow is controlled even though only one arrowhead is available for use.

The arrow is subjected to high impact forces, not only when it is shot from the bow, but also when it strikes the target. It is important that the weight composition not come loose when the arrow is subjected to these impact loads. The adhesive weight composition of this invention is capable of strongly adhering to the wall of a passage within the arrowhead head. The adhesive quality of the weight composition is such that the adherence to the wall of the passage occurs to such an extent that the weight composition will not release from the wall during normal use of the arrowhead head.

Unlike an epoxy which is hard and brittle, the weight composition of this invention is pliable, manually moldable and somewhat putty-like, when it is in the solid state. Because of these physical properties, the weight composition can flex somewhat upon impact and, for this reason, is much less likely to separate from the wall to which it is adhered than hard, brittle materials, such as epoxy. In addition, the pliability of the weight composition causes it to dampen vibrations occurring on impact.

The weight composition is preferably flowable at a temperature to which the arrowhead head can be safely subjected. This permits the weight composition to flow into the minute crevices of the passage of the arrowhead head and help bring about a strong adherence to the arrowhead head. The weight composition is sticky in the solid state, and heating of the weight composition to make it flowable enhances its stickiness.

According to the method of this invention, the weight composition of the desired weight is provided at an elevated temperature within the passage of the arrowhead head. The temperature is elevated sufficiently so that the weight composition is flowable and its stickiness is enhanced. The weight composition is then cooled to a solid state to bring about the strong adherence of the weight composition to the wall of the passage referred to above.

The weight composition is in a solid state at normal ambient temperature and the weight composition is preferably introduced into the passage in the solid state. The weight composition can be introduced into the passage in the flowable state; however, the process is safer and easier to control by introducing the weight composition into the passage in the solid state. Thereafter, the arrowhead head with the weight composition therein is heated to an elevated temperature to render the weight composition flowable. This causes the weight composition to flow into the minute crevices in the wall of the passage so that upon cooling, it can form a more intimate bond with the arrowhead.

The passage and the arrowhead in which the weight composition is placed can be located in various positions in the arrowhead. However, one common form of arrowhead has a passage opening at an end of the arrowhead remote from the pointed end and is configured such that the passage is in a tubular portion of the arrowhead.

It is common practice to adhere the arrow shaft to the tubular portion using a curable adhesive. With this invention, the heating step referred to above for heating the weight composition can also be used to cure the adhesive. Thus, a single heating step accomplishes both of these important functions. The passage and the arrowhead terminates in an end wall, and preferably, the heating step occurs with the pointed end facing downwardly so that the weight composition will also adhere to the end wall of the passage and to provide for better attachment between the arrow shaft and the arrowhead.

The weight composition is preferably compressively loaded into the passage. This can advantageously be carried out with a ram which may force the weight composition against the end wall of the passage. This compressive loading is sufficient to cause the weight composition in the solid state to stick to the wall of the passage at approximately the desired location. With this technique, the ram prepositions the weight composition and provides for initial adhesive coupling of the weight composition to the arrowhead. This initial adhesive coupling is enhanced by heating of the weight composition to the elevated temperature as described above.

The adhesive weight composition may be of any material which will strongly adhere to the wall of the passage of the arrowhead head to such an extent that the weight will not release from the wall during normal use of the arrowhead head. Of course, the weight composition must be capable of adding the required weight, and for the method of this invention, the weight composition should be flowable at elevated temperatures. A preferred weight composition comprises an adhesive composition with or without a particulate material. The particulate material is preferably of greater density than the adhesive composition, which forms a binder for the particles. For example, the particulate material may be sand or particulate metal, such as powdered lead, powdered iron or powdered copper. The particulate material is present in an amount from 0% to about 93% by weight and the adhesive composition is present in an amount of from about 7% to about 100% by weight. In a preferred weight composition, the adhesive composition is present in an amount of about 13% by weight and the particulate material is present in an amount of about 87% by weight.

The adhesive composition should become sufficiently flowable at temperatures no greater than about 500° F., which may be considered as the melting point. However, to prevent damage to some arrowheads due to the elevated temperature, it may be necessary to limit the temperature to which the weight composition is heated to a lesser temperature, such as 400° F., and the weight composition must be sufficiently flowable at such lesser temperature. Generally, the adhesive weight composition is sufficiently flowable if it has a viscosity similar to that of honey at normal room temperature. If the weight composition does not become flowable at or below this temperature, the temperatures involved could damage the arrowhead head. The adhesive composition should not have a melting point or become flowable at any reasonable temperature to which the arrowhead may be subjected following its manufacture. Generally, the melting point should not be less than 230° F.; however, it may be desirable to have a melting point as low as 210° F. to enable the weight composition to be melted with boiling water. In addition, the adhesive composition should be pliable in the solid state.

Any adhesive composition meeting the physical requirements defined above, can be employed. For example, tar and/or various tar-like adhesives could be employed.

The preferred adhesive composition includes sticky, adhesive components. In a preferred adhesive composition, polyisobutylene and petroleum hydrocarbon resins are both used. The polyisobutylene should be present in an amount from about 20% to about 75% by weight. Good results can be obtained with about 48 to about 68% by weight of polyisobutylene. At least 20% polyisobutylene is required for the desired adhesiveness but if over 75% by weight of polyisobutylene is used, the adhesive composition is too flowable. The petroleum hydrocarbon resins provide tackiness at elevated temperatures and should be present in an amount from about 5% to about 50%. Good results can be obtained with about 9 to about 19% by weight of petroleum hydrocarbon resins. If less than 5% of the hydrocarbon resins are used, the composition does not have the desired tackiness at high temperatures, and if more than 50% is used, the composition becomes too brittle.

The adhesive weight composition also preferably includes a viscosity stabilizer, such as polybutene. Polybutene is preferred because it is also a sticky, tacky substance. The polybutene is present in an amount from about 0% to about 20% by weight. If more than 20% of polybutene is used, the composition does not set hard enough in the solid state.

The preferred adhesive composition also includes plasticizers, and mineral oil and hexane are preferably both employed as plasticizers. Each of these is present in amount from about 0% to about 10% by weight. If more than 10% of either of these plasticizers is used, the composition may not have the desired adhesiveness.

The adhesive composition also preferably includes a stabilizer, and beeswax is the preferred stabilizer. Beeswax is preferably present in amount from about 0% to about 50% by weight. If more than 50% beeswax is used, the composition is too hard.

The invention, together with additional features and advantages thereof, may best be understood by reference to the following description taken in connection with the accompanying illustrative drawing.

BRIEF DESCRIPTION OF THE DRAWING

FIG. 1 is a side elevational view, partially in section, of an arrow constructed in accordance with the teachings of this invention.

FIGS. 2–3 and 5–6 are sectional views taken on an axial plane through the arrowhead and illustrating the method steps of this invention.

FIG. 4 is a sectional view taken generally along line 4—4 of FIG. 6.

DESCRIPTION OF THE PREFERRED EMBODIMENT

FIG. 1 shows an arrow 11 which comprises a weighted arrowhead 13, an arrow shaft 15 and feathers 17 at the trailing end of the arrow shaft. The arrowhead 13 contains a weight composition 19, and except for the weight composition, the arrow 11 may be of conventional construction.

Although the arrow 11 may be of various different constructions, in the embodiment illustrated, the arrowhead includes a cylindrical sleeve 21 (FIG. 2) and a body 23, with the sleeve receiving and being suitably coupled to, a cylindrical shank portion 25 of the body. The body defines an annular shoulder 27, and the sleeve 21 seats on the shoulder, with an outer annular region of the shoulder being exposed. The exposed portion of the body 23 defines a bullet-shaped nose which terminates forwardly in a pointed end 29. The sleeve 21 has an internal cylindrical wall 30 which defines an axial passage 31 that extends from a trailing end 33 of the arrowhead 13 and terminates in an end wall 35 formed on the trailing end of the body 23. The sleeve 21 rearwardly of the end wall 35 defines a tubular portion 37 of the arrowhead.

The arrow shaft 15 in the embodiment illustrated, is in the form of a cylindrical tube, the leading end portion of which receives the full length of the sleeve 21 as shown in FIGS. 1 and 6. The leading end of the arrow shaft 15 seats on the exposed portion of the shoulder 27 and is substantially flush with the outer periphery of the shoulder. The arrow shaft 15 is adhered to the arrowhead 13 by a heat curable adhesive 41 (FIGS. 5 and 6). The arrowhead 13 and the arrow shaft 15 may be constructed of suitable materials, such as aluminum. The feathers 17 are attached to the trailing end portion of the arrow shaft 15 in accordance with conventional practice.

The adhesive weight composition 19 is strongly adhered by its own adhesive qualities to the arrowhead 13. The weight composition 19 has precisely the necessary weight to place the center of gravity of the arrow 11 to the desired location which is from 7 to 9 percent of the overall length of the arrow 11 forwardly of the midpoint of the arrow. In the construction shown in FIG. 1, the weight composition 19 is located against the end wall 35 and also has a large area of contact with the internal wall 30 of the sleeve 21 to aid in strongly adhering it to both of these walls. The weight composition 19 is sticky and pliable in the solid state.

FIGS. 2, 3, 5 and 6 illustrate a preferred method of weighting the arrowhead 13. First, the correct amount of the weight composition 19 is introduced into the passage 31 through the open end of the passage to provide the desired location of the center of gravity for the arrow 11 as shown in FIG. 2.

The correct amount of the weight composition 19 can be determined in various different ways. For example, the unweighted arrowhead 13 may be inserted into the leading end of the arrow shaft 15, and the arrow then placed on a fulcrum at the desired center of gravity. Weight composition 19 is then placed in increments on the exterior of the arrowhead 13 until the arrow 11 is balanced on the fulcrum. The weight composition 19 is soft and manually moldable so pieces can be easily manually separated from a larger mass of the weight composition and placed on the arrowhead 13. The arrowhead 13 is then removed from the arrow shaft 15, and the mass of weight composition used in balancing the arrow is then introduced into the passage 31. Alternatively, weight composition can be introduced into the passage 31 to bring the arrowhead 13 to the desired weight.

When the weight composition 19 is first deposited into the passage 31, it may have any of a variety of orientations within the passage. To properly place the weight composition 19 in the passage and to obtain significant initial adherence of the weight composition to the walls of the passage, the weight composition is compressively loaded against the walls of the passage and the end wall 35 by a ram 43 as shown in FIG. 3. The ram 43 is preferably manually operated and acts to axially compressively load the weight composition 19 between the inner end of the ram and the end wall 35. Because the weight composition 19 is pliable and extrudable, this axial compressive force causes the weight composition to extrude radially into tight engagement with the inner wall of the sleeve 21. The weight composition 19 is somewhat like adhesive tape and tends to stick against the walls of the arrowhead 13.

Next, the outer wall of the sleeve 21 is coated with the heat-curable adhesive 41 as shown in FIG. 5. If desired, the interior wall of the shaft 15 at the forward end of the shaft may also be coated with the adhesive.

Next, the sleeve 21 of the arrowhead 13 is inserted into the leading end portion of the arrow shaft 15 as shown in FIG. 6, and the composite structure is heated by a suitable heater 45 as shown in FIG. 6. The arrow 11 may be supported in a suitable fixture (not shown) while in the heater 45, and the arrow is preferably vertically oriented with the pointed end 29 facing downwardly.

In this embodiment, the heater 45 heats the arrow 11 and the weight composition 19 to an elevated temperature which is no more than 400° F. and which is sufficient to cause the weight composition 19 to become flowable. Temperatures over 400° F. may damage the aluminum arrow shaft 15. For the particular weight composition 19 suggested in the specific embodiment, the weight composition may be heated, for example, to about 300° F. This causes the weight composition 19 to flow with about the viscosity of honey into intimate contact with the adjacent surfaces and minute crevices of the end wall 35 and the internal wall 30 of the sleeve 21 (FIGS. 4 and 6) and further tends to enhance the stickiness of the weight composition. Moreover, the flowing of the weight composition 19 assists with the final positioning of the weight composition within the passage 17. The heating of the arrow 11 also cures the adhesive 41 to firmly attach the arrowhead 13 to the arrow shaft 15.

After a period of about twelve to thirty minutes at an elevated temperature, the arrow 11 and the weight composition 19 are allowed to cool. This allows the weight composition 19 to return to the solid state in which it is pliable and has essentially the same physical properties as before it was heated. It also brings about the strong adherence of the weight composition 19 to the arrowhead 13 as described above.

The steps of this method can be carried out by the manufacturer, the archer, or by both. Thus, the arrowhead 13 may be sold as a preweighted arrowhead in the form shown in FIGS. 2 or 3. Alternatively, the arrowhead 13 and the weight composition 19 may be heated alone apart from the arrow shaft 15 to provide appropriately weighted arrowheads which can be subsequently attached to an arrow shaft.

The preferred weight composition 19 utilizes 13 percent by weight of an adhesive composition and about 87 percent by weight of powdered lead. The preferred adhesive composition comprises several components suitably mixed together and preferably has the following composition:

| Ingredients | Percent by Weight |
|---|---|
| polyisobutylene | 58 percent |
| polybutylene | 9 percent |
| mineral oil | 6 percent |
| hexane | 6 percent |
| beeswax | 7 percent |
| petroleum hydrocarbon resins | 14 percent |

Although an exemplary embodiment of the invention has been shown and described, many changes, modifications and substitutions may be made by one having ordinary skill in the art without necessarily departing from the spirit and scope of this invention.

I claim:

1. A method of weighting an arrowhead having a wall defining an interior passageway opening at a surface of the arrowhead and a pointed end for penetrating an object, said method comprising: introducing a weight composition of the desired weight, and including a sticky adhesive composition, in a solid state into the passage with the weight composition being sticky in the solid state and heating the arrowhead and weight composition to an elevated temperature to render the weight composition flowable and to enhance the stickiness of the weight composition; and cooling the weight composition to a solid state to strongly adhere the weight composition to the wall of the interior passage to such an extent that the weight composition is not likely to release from the wall during normal use of the arrowhead.

2. A method as defined in claim 1 wherein the weight composition is pliable in the solid state.

3. A method as defined in claim 1 wherein the weight composition includes particulate material in the adhesive composition.

4. A method as defined in claim 1 wherein the step of heating enhances the stickiness of the weight composition.

5. A method as defined in claim 4 wherein the weight composition includes particulate material in the adhesive composition and said step of heating is carried out to heat the weight composition to a temperature no greater than about 400° F. and no leass than about 210° F.

6. A method as defined in claim 1 wherein said step of introducing includes compressively loading the weight composition against the wall of the passage.

7. A method as defined in claim 1 wherein the step of introducing includes placing the weight composition in the passage, inserting a ram through the opening into the passage and using the ram to force the weight composition against the wall of the passage.

8. A method as defined in claim 7 wherein the passage terminates in an end wall and the ram forces the weight composition against said end wall.

9. A method as defined in claim 1 including providing an arrow shaft, applying a heat-curable adhesive to at least one of the arrowhead and the arrow shaft, contacting the arrowhead and the arrow shaft at said adhesive, carrying out said step of heating with the pointed end facing downwardly and using said step of heating to cure said adhesive to attach the arrowhead to the arrow shaft.

10. A method as defined in claim 1 wherein the arrowhead has a tubular portion which contains said passage and said method includes providing an arrow shaft having a passage, applying a heat-curable adhesive to at least one of said tubular portion and said passage of said arrow shaft, inserting said tubular portion of said arrowhead into the passage of the arrow shaft subsequent to said step of introducing and using said step of heating to cure said adhesive to attach the arrowhead to the arrow shaft.

11. A method as defined in claim 1 wherein said step of heating is carried out to heat the weight composition to a temperature no greater than about 500° F. and no less than about 210° F.

12. A weighted arrowhead comprising:

an arrowhead having a wall defining an interior passage opening at a surface of the arrowhead and a pointed end for penetrating an object;

an adhesive weight composition which is sticky in the solid state and cured in situ, said weight composition being strongly adhered by the adhesive quality of the weight composition to the wall of the passage to such an extent that the weight composition is not likely to release from the wall during normal use of the arrowhead; and the weight composition being at least somewhat pliable in the solid state.

13. A weighted article as defined in claim 12 wherein the arrow includes a shaft coupled to the arrowhead.

14. A weighted article as defined in claim 12 wherein the arrowhead has a tubular portion which contains said passage and said passage opens at an end of the arrowhead remote from the pointed end, said arrow includes a shaft adhered to the tubular portion.

15. A weighted article as defined in claim 12 wherein said weight composition comprises particulate material dispersed in a sticky adhesive composition.

16. A weighted article as defined in claim 12 wherein said weight composition consists essentially of about 7 percent to about 100 percent by weight of an adhesive composition and from about 0 percent to about 93 percent by weight of a particulate material dispersed in the adhesive composition, said particulate material having a greater density than the adhesive composition, and said adhesive composition having a melting point between about 230 degrees F. and 500 degrees F.

17. A weighted article as defined in claim 16 wherein said adhesive composition consists essentially of from about 20 percent to about 75 percent by weight of polyisobutylene, from 0 percent to about 20 percent by weight of polybutene, from 0 percent to about 10 percent by weight of mineral oil, from 0 percent to about 10 percent by weight of hexane, from 0 percent to about 50 percent by weight of beeswax, and from about 5 percent to about 50 percent by weight of petroleum hydrocarbon resins.

18. A method of weighting an arrowhead having a wall defining an interior passage opening at a surface of the arrowhead and a pointed end for penetrating an object, said method comprising:

introducing a weight composition of the desired weight in a solid state into the passage with the weight composition comprising a sticky adhesive composition and particulate material in the sticky adhesive composition;

heating the arrowhead and weight composition to an elevated temperature to render the weight composition flowable; and cooling the weight composition to a solid state to strongly adhere the weight composition to the wall of the passage to such an extent that the weight composition is not likely to release from the wall during normal use of the arrowhead.

* * * * *